US006561378B1

(12) United States Patent
Roessler et al.

(10) Patent No.: US 6,561,378 B1
(45) Date of Patent: May 13, 2003

(54) TISSUE DISPENSING APPARATUS

(76) Inventors: Thomas H. Roessler, 1034 Greendale Ct., Kenosha, WI (US) 54952; Yung H. Huang, 2420 W. Seneca Dr., Appleton, WI (US) 54914; Barbara A. Lyon, 312 S. Patricia Dr., Swedesboro, NJ (US) 08085; Franklin M. C. Chen, 1820 W. Glendale Ave., Appleton, WI (US) 54914

( * ) Notice: Subject to any disclaimer, the term of this patent is extended or adjusted under 35 U.S.C. 154(b) by 0 days.

(21) Appl. No.: 09/630,747

(22) Filed: Aug. 2, 2000

(51) Int. Cl.[7] ..... A47K 10/24
(52) U.S. Cl. ..... 221/45; 224/277
(58) Field of Search ..... 221/45, 46, 33, 221/282; 248/905; 224/277, 483

(56) References Cited

U.S. PATENT DOCUMENTS

| | | | | | |
|---|---|---|---|---|---|
| 2,287,581 | A | * | 6/1942 | Walker | 224/277 |
| 2,990,950 | A | * | 7/1961 | Alexander | 221/45 |
| 3,476,257 | A | * | 11/1969 | O'Connell | 221/45 |
| 4,416,392 | A | * | 11/1983 | Smith | 221/45 |
| 4,880,682 | A | * | 11/1989 | Hazelton et al. | 428/152 |
| 5,042,091 | A | | 8/1991 | Tonkens | |
| 5,123,566 | A | * | 6/1992 | Lage et al. | 221/46 |
| 5,165,570 | A | * | 11/1992 | Windorski et al. | 221/46 |
| 5,516,567 | A | | 5/1996 | Roessler et al. | |
| 5,886,089 | A | * | 3/1999 | Knowlton | 524/544 |
| 6,241,619 | B1 | * | 6/2001 | Russell | 464/183 |

FOREIGN PATENT DOCUMENTS

| | | | | |
|---|---|---|---|---|
| FR | 1315415 | * | 12/1962 | 221/45 |

* cited by examiner

*Primary Examiner*—Kenneth W. Noland
(74) *Attorney, Agent, or Firm*—Dority & Manning, P.A.

(57) ABSTRACT

A tissue container having a plurality of walls and a lower surface is capable of dispensing tissues to users. The container may resist unwanted movement when placed upon a flat surface due in part to a non-skid friction enhancement device that is affixed to the lower surface of the container. The tissue container also may be removably affixed to an object or surface by way of adhesive, such that the container resists movement when a tissue is pulled from the container. The container may have an adhesive on its lower surface, such that the adhesive is exposed by removing a protective covering or layer from the adhesive.

29 Claims, 2 Drawing Sheets

TISSUE DISPENSING APPARATUS

BACKGROUND OF THE INVENTION

Tissue dispensers provide access to tissues in a convenient format for use by consumers. Most tissue dispensers are constructed of lightweight disposable paper stock, but some comprise lightweight plastic or other materials. As tissues from a disposable container are consumed, the overall weight of the dispensing container is correspondingly reduced.

In some instances, the force generated by pulling a tissue from a container (especially a container only partially filled) is greater than the frictional forces holding the container on the surface where it rests. When this occurs, the container may undesirably slide across the surface, or may fall upon the floor. In some cases, this situation requires that a user pull a tissue from a container in a "two handed" operation in which one hand holds the container while the other hand pulls the tissue. Many users find this two-handed operation undesirable.

Tissues are used in automobiles and boats as well. Tissue containers placed upon flat surfaces in such vehicles often move about or slide away from their location upon such flat surfaces, and fall upon the floor. This occurs when the containers are subjected to forces caused by movement of the automobile. Thus, containers that move in this way pose a danger to drivers and passengers when the containers shift their position suddenly, or when the containers move within the vehicle at a relatively high velocity. Tissue containers used in such vehicles are routinely subjected to forces that cause them to fall or slide from where they would be the most beneficial into areas which are inaccessible. It would be desirable to provide a system or container which is capable of being removably affixed to a surface in the home, office, or automobile. A method and apparatus that is capable of reliably dispensing tissues without unnecessary movement of the container is advantageous. A container which has an increased level of friction against surfaces upon which it rests would be useful.

SUMMARY OF THE INVENTION

The invention can assume several different alternative embodiments. Some of those alternative embodiments are described below.

A tissue dispenser is provided comprising a container, the container having a plurality of walls defining a container cavity. In general, the cavity includes tissues that are removably positioned within the container cavity. The container also includes an upper surface. An opening on the upper surface provides for access to the container cavity, the container having a lower surface adapted for supporting the container in an upright position, wherein the lower surface further comprises an interior side and an exterior side, the exterior side having a friction enhancement device.

In one aspect of the invention, the container provides a friction enhancement device which is a non-skid surface. A container also is provided which comprises a non-skid surface including a polymer. The container may include a block copolymer.

In another embodiment of this invention, the friction enhancement device comprises an adhesive capable of removably affixing the lower surface of the container to an object when the container is resting in an upright position. The container also may be provided in which the adhesive is exposed by removal of a surface layer from the lower surface of the container. In general, the container may be provided in which the surface layer is a film barrier. The container also may include a friction enhancement device that comprises both a non-skid surface and an adhesive.

The container may employ an adhesive that is a low tack adhesive which is capable of removably securing the container to an object substantially without leaving a residue of adhesive on the surface of the object. The container also may employ adhesive in at least two locations on the exterior side of the lower surface.

The container also may provide adhesive to less than one-half of the exterior side of the lower surface. In one embodiment of the invention, the tissue dispenser comprises a container, the container having a plurality of walls defining a container cavity. In this particular embodiment, the container has a lower surface with an interior side and an exterior side, the exterior side having a non-skid region comprised of polymer. The non-skid region functions to increase the coefficient of friction of the exterior side at the lower surface of the container.

The container also may provide a coefficient of friction which is at least about 0.4. In some cases, the container provides a polymer with a metallocene catalyzed polyolefin elastomer. In some applications, the polymer is applied to the container as a hot melt bead. The container also may be comprised of a film. In some embodiments, the polymer may be an elastomeric foam. In other embodiments, the polymer is a latex rubber.

The container also may provide a tri-block copolymer on its lower surface for increasing frictional resistance. The container also may be provided in which the polymer is a poly(styrene-co-ethylene butylene-co-styrene) tri-block copolymer. A system for dispensing tissues also is available for providing an increase in frictional resistance upon the surface of an object. The system may include a container, wherein the container has walls defining a container cavity. Further, the cavity includes tissues positioned within the container cavity. In another system of the invention, the lower surface of the container is adapted for supporting the container in an upright position. The lower surface further comprises an interior side and an exterior side.

In many embodiments, the container comprises a non-skid surface adapted for increasing the friction between the exterior side of the lower surface of the container and the object. The system also may include a non-skid surface comprising a polymeric material that is mounted upon the exterior side of the lower surface of the container. In some embodiments, the system provides an adhesive upon the exterior side of the lower surface of the container. Sometimes, a removable layer is applied which serves to protect the adhesive until a later time at which the adhesive is exposed and secured to the object. A system also is provided in which the adhesive is a low tack adhesive.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
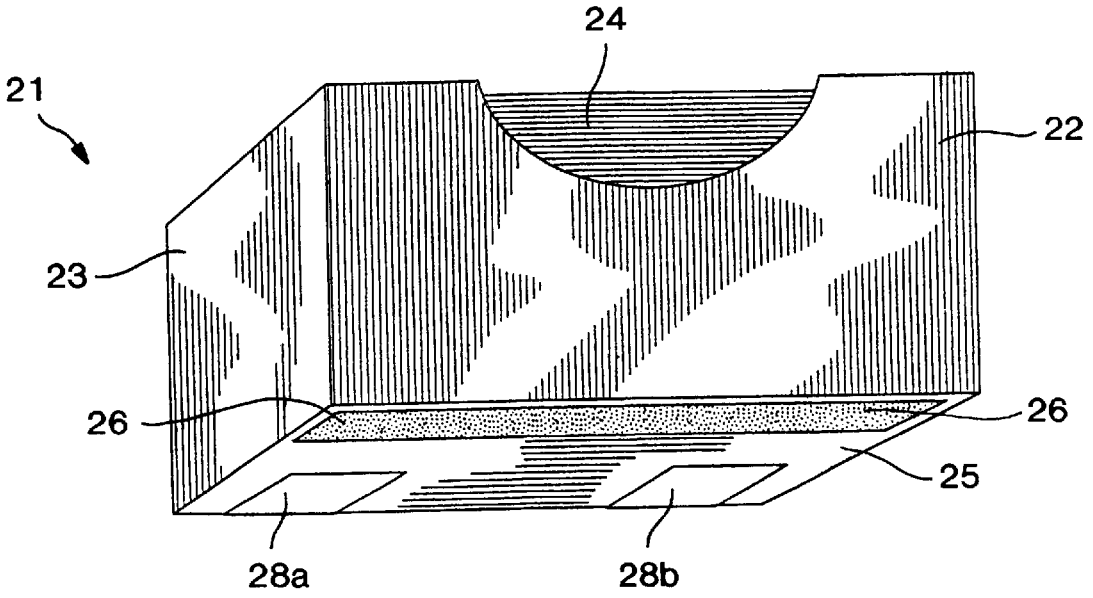
FIG. 1 is a drawing which shows a perspective view of one embodiment of a dispenser of the invention.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

This invention provides an improved tissue dispenser with non-skid regions that provide relatively high shear strength. The regions of enhanced shear strength are preferably positioned on the base or lower surface of the container. The non-skid regions serve to increase resistance encountered when the container slides across a surface as tissues are dispensed. A relatively high peel strength region with adhesive may also be provided as an optional means to decrease undesirable movement of the container.

In general, when tissues are removed from a container, the container weight (with tissues inside) resists movement. The friction of the tissue against the container opening sometimes promotes movement of the container. If the container is tilted forward, then the contact area of the container on the flat surface is reduced, which can have the effect of accelerating undesirable movement of the container across a surface. In the application of the invention, hot melt adhesive may be applied across the lower surface of the container. In some cases it is extruded as a bead across the lower surface of the container. In other applications, a low tack adhesive is provided on the lower surface of the box in addition to or as a supplement to the friction enhancement means. Thus, while the friction enhancement device or means serves to resist lateral movement, the application of the adhesive can also resist movement of the container directly upwards, as when a tissue is withdrawn upwards rather than laterally.

The adhesive areas may be covered by tape or film that can be peeled back or removed when the container is to be applied to the flat surface. In some applications, polyurethane foam can be used as a friction enhancement means. In other applications, a polymer is used. One polymer that may be applied is a block copolymer known as Kraton-G®, which is a chemical adhesive produced by the Shell Chemical Company of Houston, Tex. "Kraton-G" is a trademark of Shell Chemical Company. This material is a metallocene catalyzed polyolefin elastomer of poly(styrene-co-ethylene butylene-co-styrene) tri-block copolymer. Other versions of Kraton polymers could also work well in the invention, and block copolymers of various types could be used. In general, any polymer capable of a relatively straightforward and simple application to a container could be used to provide a non-skid surface, provided it increases frictional resistance of the container with a flat surface.

The supporting surface for the container may be a table top, a desk, a dashboard, boat, or practically any other surface from which tissues are dispensed and stored. The surface need not be completely flat or planar. The dispenser can also be used in locations where tissue boxes are not normally found, such as lockers or file cabinets, or even to the underside of a shelving unit.

In other embodiments, tissues may be dispensed from other locations on the dispenser. For example, the dispensing opening may be located centrally upon the top surface. When tissues are dispensed from this location, the dispensing forces may originate from any combination of vector forces in the x, y, or z direction. Having a high peel region at all four corners of the dispenser, or even covering the entire bottom surface of the dispenser, may reduce unwanted movement of the dispenser when tissues are removed. It may not be necessary to totally eliminate movement of the dispenser when a tissue is dispensed. For example, when a non-skid layer is applied to the bottom surface of the dispenser, this limits the amount of movement of the dispenser—which aids in removal of tissue from the container.

In another embodiment of the invention, the entire outer surface of the dispenser may be coated with a non-skid material. For example, a soft pack of tissues could be made from a relatively high coefficient of friction film such as metallocene polyethylene film.

The coefficient of friction is tested using a moving sled and a stationary plane. A portion of the underside of a tissue box is affixed to the bottom of the sled. The sled slides laterally across the stationary plane by a pulling arm. A gage attached to the sled measures the force needed to begin movement of the surfaces relative to each other also known as the coefficient of friction and this data is recorded.

The test method used in this application is a derivative of ASTM method D1894-93. The tester and sled are available commercially from Testing Machines Inc. located in Islandia, N.Y. The tester is TMI model 32-06 and the sled is TMI part number 32-06-02. The revisions made to ASTM method D1894-93 involves modifying the stationary plane surface and speed of the sled. The stationary plane is a polished number 316 stainless steel with 32 micron finish 12" long, 6" wide, and ¼" thick. The speed of the sled is 6.0 inches per minute +/−0.5 seconds.

Tests were conducted using two samples. The first sample is a standard tissue box and the second sample is a standard tissue box with Kraton film adhered to the bottom. The test was conducted five times for each sample and the tissue box with the Kraton layer had a coefficient of friction more than ten times greater than the standard tissue box without the Kraton layer. As seen in Table 1, the coefficient of friction was substantially increased when the Kraton was added to the lower surface of the container.

TABLE 1

COEFFICIENT OF FRICTION

| Test Number | Sample 1 Standard Tissue Box | Sample 2 Tissue Box with Kraton Layer |
|---|---|---|
| 1 | 0.1563 | 2.334 |
| 2 | 0.1569 | 2.749 |
| 3 | 0.1344 | 2.820 |
| 4 | 0.1526 | 3.344 |
| 5 | 0.1490 | 2.449 |
| Average | 0.1498 | 2.739 |

Figure 2:
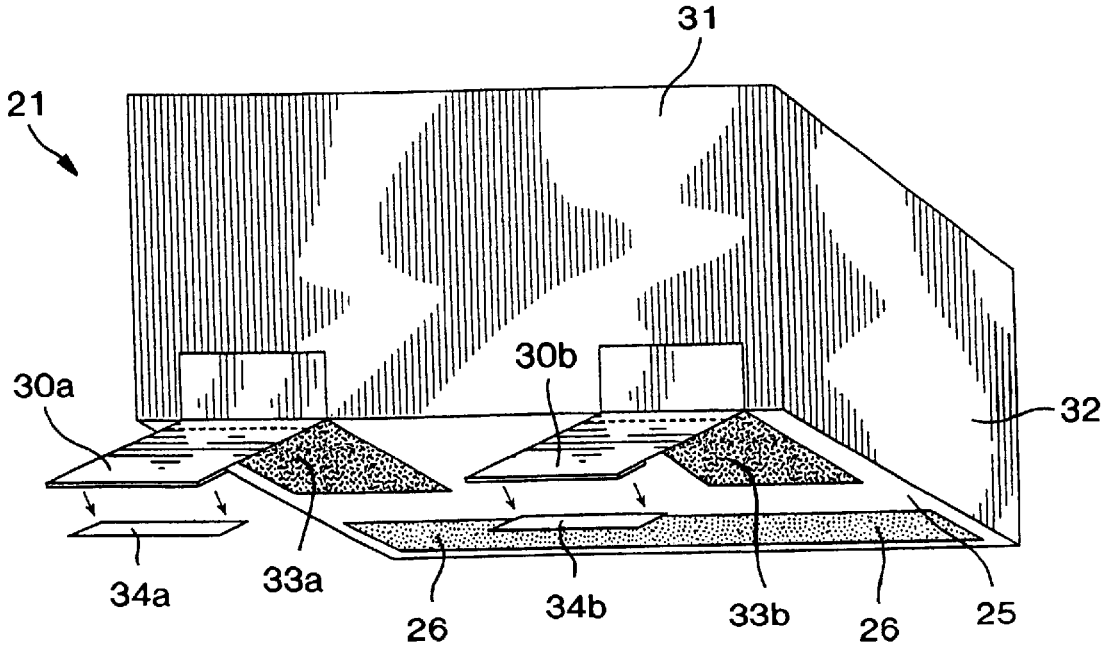
FIG. 2 shows the backside of the embodiment of the invention shown in FIG. 1.

Turning now to the Figures, FIG. 1 shows a dispenser 21 comprising a container 22 with an end wall 23 and tissues 24 stored within a cavity in the container. The lower surface 25 (exterior side) of the container further includes a nonskid region 26 and adhesive patches 28*a* and 28*b*. These patches typically are applied to the container during container manufacture, and may be covered with a film layer. In some embodiments, there will be no patches at all, or only one patch. Other embodiments will include two, three, four, five or more patches on the underside of the container. FIG. 2 shows the container of FIG. 1 from the back side. Surface layers 30*a* and 30*b* are shown partially peeled from the surface of exposed adhesive 33*a* and 33*b*. Back wall 31 and end wall 32 are shown as well. Peelable thumb panels 34*a* and 34*b* may be used for better gripping when peeling the panels from the adhesive surface. Then, once the panels are peeled from the surfaced, the peelable thumb panels, which comprise film or similar material, may be removed to expose the maximum amount of adhesive for application of the surface layers 30*a* and 30*b* to the surface to which the container is to be applied. The thumb panels are typically formed by folding over an adhesive tape substrate onto itself during manufacturing. Usually, thumb panels are not opened once they are sealed.

Figure 3:
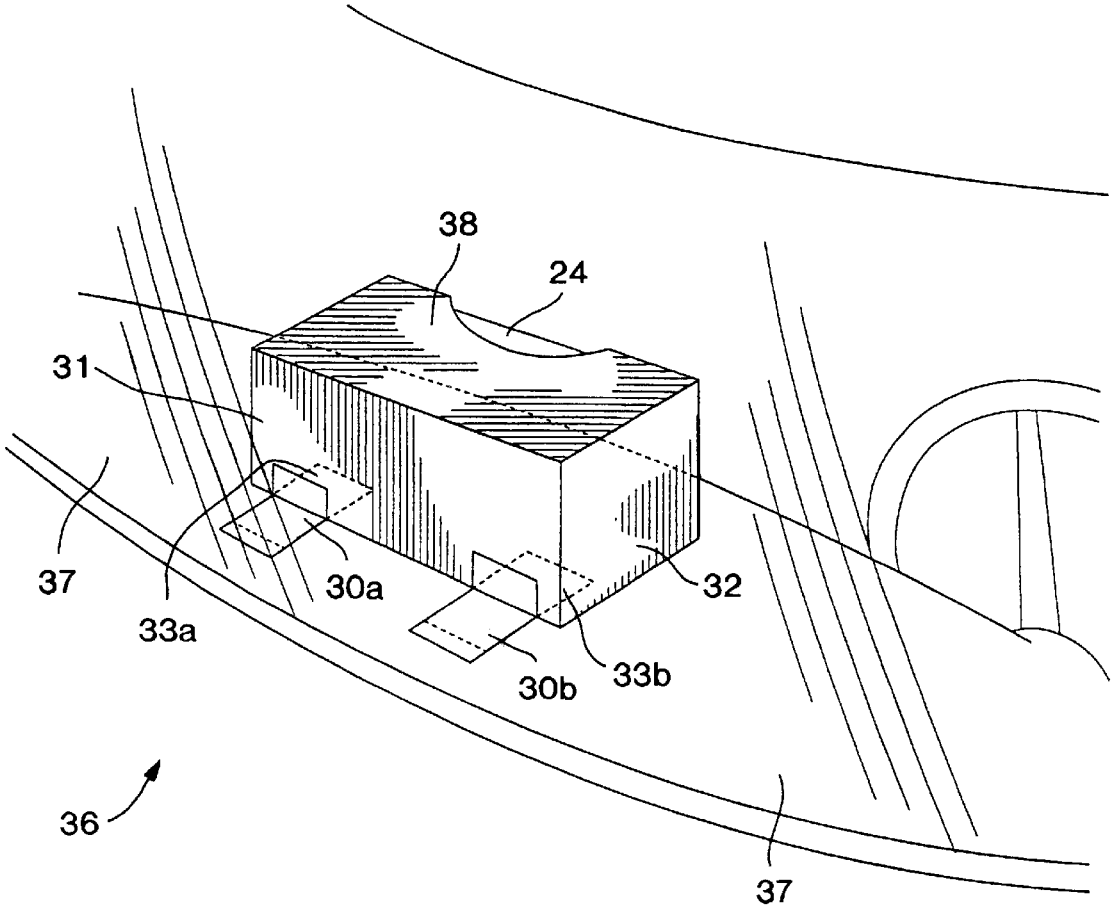
FIG. 3 depicts a typical installation of the dispenser in an automobile.

FIG. 3 shows one automobile application 36 in which the dispenser shown in FIGS. 1 and 2 is mounted in an automobile. In this type of application, both the nonskid region 26 (as shown in FIGS. 1 and 2) and the adhesive patches 33*a* and are applied to keep the dispenser in place and to prevent undesirable movement around the automobile when subject to forces caused by movement of the automobile. FIG. 3 shows a top panel 38 and the tissues 24 which are ready for dispensing to occupants of the automobile. Of course, the invention may employ only an adhesive patch, or only a non-skid region, or both. It may employ any number of adhesive patches or nonskid regions. The dispenser may be placed in any convenient place in an automobile, boat, or other vehicle where undesirable movement of the dispenser is to be eliminated.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A disposable, lightweight tissue dispenser, comprising:

(a) a container made from paper stock, the container having a plurality of walls defining a container cavity, the cavity having tissues removably positioned within the container cavity, (b) the container further having an upper surface, wherein an opening in the container provides for access to the container cavity, (c) the container having a lower surface adapted for supporting the container in an upright position, wherein the lower surface further comprises an interior side and an exterior side, the exterior side having a non-skid surface adapted to resist movement of the container when tissues are removed from the container.

2. The container of claim 1 in which the non-skid surface is comprised of a polymer adapted to provide an increased coefficient of friction.

3. The container of claim 2 in which the polymer is a block copolymer.

4. The container of claim 1 in which the non-skid surface is provided in combination with an adhesive capable of removably affixing the lower surface of the container to an object when the container is resting in an upright position.

5. The container of claim 4 in which the adhesive is exposed by removal of a surface layer from the lower surface of the container.

6. The container of claim 5 in which the surface layer is a film barrier.

7. The container of claim 4 wherein the adhesive is provided upon at least three corners of the lower surface of the container.

8. The container of claim 7 in which the adhesive is a low tack adhesive capable of removably securing the container to an object substantially without leaving a residue of adhesive on the surface of the object.

9. The container of claim 8 in which the adhesive is applied in at least two locations on the exterior side of the lower surface.

10. The container of claim 8 in which the adhesive is applied to less than one-half of the exterior side of the lower surface.

11. The container of claim 5 in which the removable surface layer is attached to the container, the removable surface layer being comprised of an adhesive area that may be exposed by removing a cover panel.

12. A tissue dispenser, comprising:

a container, the container having a plurality of walls defining a container cavity, the cavity having tissues removably positioned within the container cavity, the container further having an upper surface, wherein an opening in the container provides for access to the container cavity, the container having a lower surface adapted for supporting the container in an upright position and for contacting an adjacent surface upon which the container rests, wherein the lower surface further comprises an interior side and an exterior side, the exterior side having a non-skid region comprised of polymer that functions to increase the coefficient of friction of the exterior side of the lower surface of the container, the non-skid region only partially covering the exterior side of the lower surface.

13. The container of claim 12 in which the coefficient of friction of the container is at least about 0.4.

14. The container of claim 12 in which the polymer comprises a metallocene catalyzed polyolefin elastomer.

15. The container of claim 12 in which the polymer is a hot melt bead.

16. The container of claim 12 in which the polymer is a film.

17. The container of claim 12 in which the polymer is an elastomeric foam.

18. The container of claim 12 in which the polymer is a latex rubber.

19. The container of claim 12 in which the polymer is a tri-block copolymer.

20. The container of claim 12 in which the polymer is poly(styrene-co-ethylene butylene-co-styrene) tri-block copolymer.

21. A system for dispensing tissues from a lightweight, disposable container located upon the surface of an object, comprising:

(a) a container, the container having walls defining a container cavity, the cavity including tissues positioned within the container cavity;

(b) a lower surface in the container, the lower surface being adapted for supporting the container in an upright position, wherein the lower surface further comprises an interior side and an exterior side, (c) a non-skid surface adapted for increasing the friction between the exterior side of the lower surface of the container and the object, thereby providing stability to the container as tissues are pulled from the container; and (d) in addition to the non-skid surface, an adhesive being located upon the exterior side of the lower surface of the container.

22. The system of claim 21 in which the non-skid surface comprises a polymeric material mounted upon the exterior side of the lower surface of the container.

23. The system of claim 21 further comprising a removable layer which protects the adhesive until the time at which the adhesive is exposed and secured to the object.

24. The system of claim 23 in which the adhesive is a low tack adhesive.

25. The container of claim 23 in which the removable layer is connected to the container, the removable layer being comprised of an adhesive area that may be exposed by the removal of a cover panel.

26. A soft pack of tissues comprising:

a plurality of tissues; and a flexible container surrounding the plurality of tissues, the flexible container comprising a lightweight plastic material, the container including a bottom surface, the bottom surface comprising a relatively high coefficient of friction film, the film comprising a non-skid material.

27. A soft pack of tissues as defined in claim 26, wherein the relatively high coefficient of friction film comprises a metallocene catalyzed polymer.

28. A soft pack of tissues as defined in claim 26, wherein the entire container is coated with the relatively high coefficient of friction film.

29. A soft pack of tissues as defined in claim 26, wherein the relatively high coefficient of friction film has a coefficient of friction of at least about 0.4.

* * * * *

UNITED STATES PATENT AND TRADEMARK OFFICE

CERTIFICATE OF CORRECTION

PATENT NO. : 6,561,378 B1
DATED : May 13, 2003
INVENTOR(S) : Roessler et al.

It is certified that error appears in the above-identified patent and that said Letters Patent is hereby corrected as shown below:

Title page,
Item [73], Assignee, add -- Kimberly-Clark Worldwide, Inc. Neenah, WI (US) --

Signed and Sealed this

Twenty-fifth Day of November, 2003

JAMES E. ROGAN
*Director of the United States Patent and Trademark Office*